United States Patent [19]

Morris

[11] 4,043,510

[45] Aug. 23, 1977

[54] NON-AEROSOL TYPE DISPENSER

[76] Inventor: William E. Morris, 1831 N. Douglas, Appleton, Wis. 54911

[21] Appl. No.: 633,971

[22] Filed: Nov. 21, 1975

[51] Int. Cl.[2] ..... B05B 11/02

[52] U.S. Cl. ..... 239/323; 239/328; 239/322

[58] Field of Search ..... 222/386.5, 395; 239/321, 322, 323, 328, 526, 583, 318; 220/300

[56] References Cited

U.S. PATENT DOCUMENTS

| | | | |
|---|---|---|---|
| 2,079,933 | 5/1937 | Fisher | 239/526 X |
| 2,125,573 | 8/1938 | Kelley, Jr. | 239/526 X |
| 2,177,032 | 10/1939 | Baumgardner | 239/328 X |
| 2,597,650 | 5/1952 | Maehren | 239/321 X |
| 2,665,028 | 1/1954 | Hintz | 220/300 |
| 2,671,689 | 3/1954 | Wett | 239/321 X |
| 3,236,459 | 2/1966 | McRitchie | 239/318 X |
| 3,282,473 | 11/1966 | Moore | 239/322 X |
| 3,432,104 | 3/1969 | Kaltenbach | 239/328 |

FOREIGN PATENT DOCUMENTS

| | | | |
|---|---|---|---|
| 64,719 | 12/1955 | France | 239/323 |
| 588,631 | 8/1932 | Germany | 239/323 |

*Primary Examiner*—John J. Love

*Attorney, Agent, or Firm*—McDougall, Hersh & Scott

[57] ABSTRACT

A portable, hand operated dispenser for spraying fluid composition under pressure wherein a fluid composition to be sprayed is contained in a fluid impervious flexible bag housed within the container and the content material is forced from the bag by continuous pressure operating on the outside of the bag from an available source.

2 Claims, 6 Drawing Figures

FIG. 3
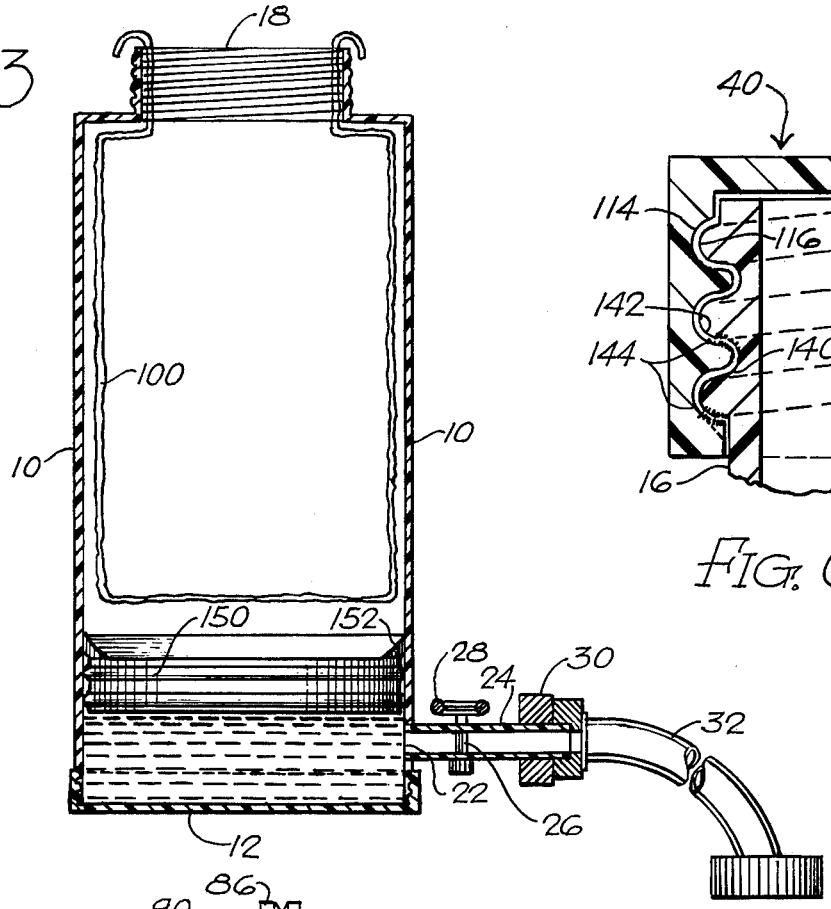
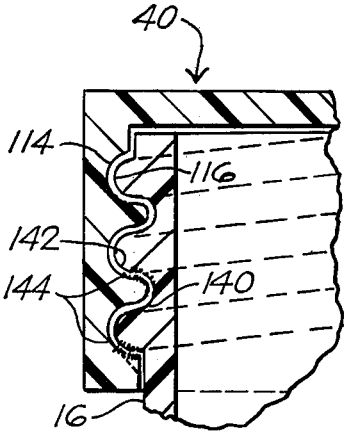
FIG. 6
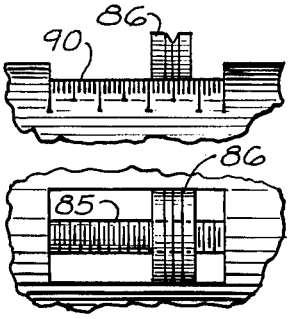
FIG. 5
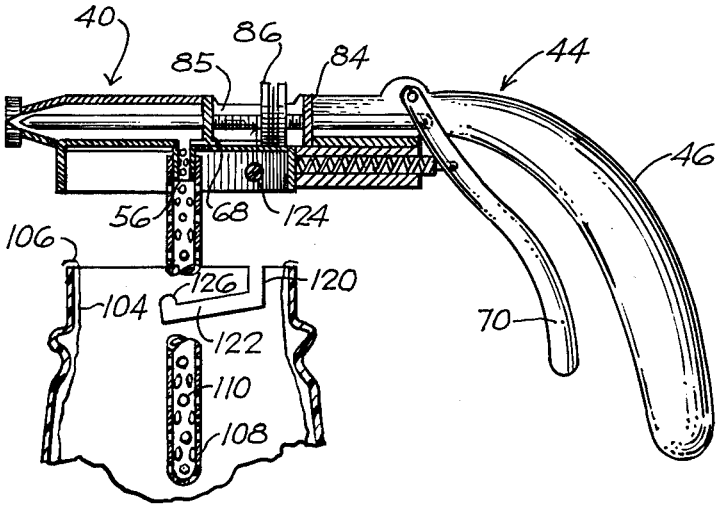
FIG. 4

NON-AEROSOL TYPE DISPENSER

This invention relates to a portable, hand operated, non-aerosol type dispenser for fluid substances such as paints, varnishes, finishes, insecticides, herbicides, lubricants, fertilizers and the like substances of fluid consistency or fluid compositions in the form of solutions, dispersions, emulsions or suspensions. It relates more particularly to a portable pressure operated, hand held sprayer which can be used interchangeably for dispensing different types of fluid compositions and in which dispensing pressure is derived from fluid under pressure which is introduced during or immediately prior to use.

To the present, fluid compositions of the type described have been dispensed by spraying from an aerosol type container, in which use is made of a Freon type propellant for emission in response to valve control. Aside from the ecological objection to the use of aerosol type dispensers, such dispensers find objections for a number of additional reasons including the danger of explosion by reason of the continuous pressure from the propellant confined within the container; the continuous pressure on the material in the aerosol type container causes leakage with resultant undesirable dispensing of material during storage or periods of non-use, and loss of material and pressure whereby insufficient pressure or materials remain to be dispensed when it is desired to make use thereof.

More recently, environmentalists have raised serious objections to the contamination of the atmosphere by the aerosol propellants released from such containers whereby the trend is towards banning the use of such dispensers in the home as well as in industry.

There is a need for a simple and safe dispenser for home use, which can be operated and in which dispensing pressure can be generated at the time of use by pressurizing means readily available and easily introduced into the dispenser, thereby to avoid the dangers and leakages characteristic of aerosol type dispensers, and in which the pressurizing medium is free of any objections from the standpoint of contamination, pollution or other objections leveled at propellants of the type used in aerosol dispensers and it is an object of this invention to produce a dispenser of the type described for dispensing fluid substances.

These and other advantages of this invention will hereinafter appear and for purposes of illustration, but not of limitation, embodiments of the invention are shown in the accompanying drawings in which:

FIG. 3 is a sectional view of a modification in the container which may be employed in the practice of this invention;

FIG. 4 is an elevational view similar to that of FIG. 2 showing a modification in the means for removably mounting the spray head onto the container;

FIG. 5 is an enlarged view showing the calibration means for the setting of the needle valve; and FIG. 6 is an enlarged sectional view of the thread construction for mounting the cap onto the spray bottle in a manner to prevent removal while the pressurizing means remains effective.

Figure 1:
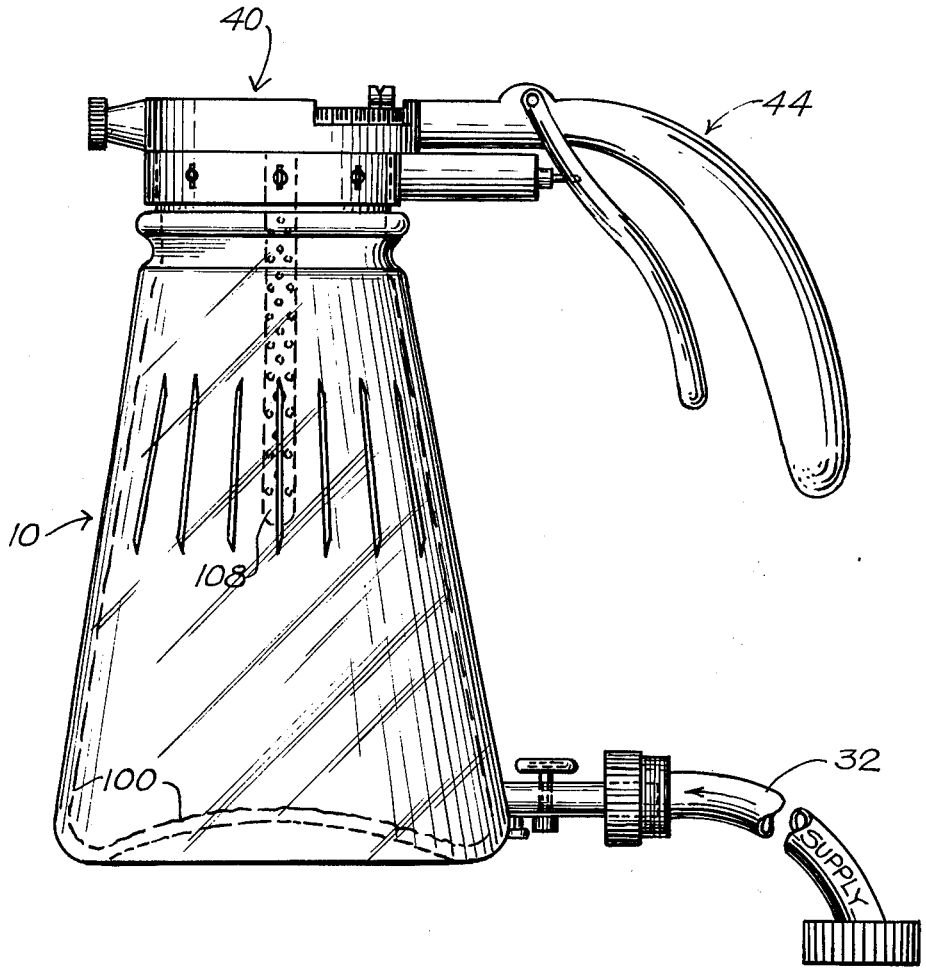
FIG. 1 is an elevational view showing the dispenser of this invention embodied in the spray bottle.

The invention will be described with reference to a glass container of Erlenmeyer shape for housing the fluid material to be dispensed under pressure introduced into the container and released from a spray head adapted removably to be mounted in sealing relation on the mouth of the open upper end of the container. It will be understood that the container may be formed of other shape in cross-section, such as round, square, hexagonal, rectangular, octagonal, elliptical, and the like as well as cylindrical, frustoconical and the like shapes in vertical section, and that the container may be formed of materials other than glass, such as sheet metal, plastics, metal or plastic lined paperboard, and the like relatively rigid and relatively strong structural material. The container walls may be transparent or translucent, as when formed of glass or plastics, without visibility therethrough when formed of a metal, metal laminate, or filled plastic or glass.

With reference now to the drawings, the container 10 is preferably in the form of an elongate container having greater height than width and preferably having a concave bottom wall 12 that extends curvilinearly upwardly from the rounded corner portions 14 which lead into the vertically disposed side walls 16 which terminate in an open mouth 18 at the upper end. The side walls are preferably formed with vertically disposed, circumferentially spaced apart ribs 20 in intermediate portions to enable the container firmly to be gripped, especially during engagement or disengagement of the spray head adapted to be mounted in sealing relation on the open mouth end portion of the container.

An inlet 22 is provided in the side wall 16 of the container 10 adjacent the bottom wall 12. An adapter in the form of a tubular section 24 is joined to the container, in communication with the opening. The tubular member is provided with a valve member such as a butterfly valve 26 adapted to be rotated by valve stem 28, extending outwardly of the tubular member, for turning the valve between on and off positions, respectively, to open and close the passage through the tubular member 24. The end of the short tubular section 24 is provided with a coupling 30 for connection with the end of a garden hose 32, air hose or the like for communicating the interior of the container with normal water supply available in the home or facility, or for communicating the container with a source of supply of pressurized air or gas.

Adapted to be mounted in sealing relation on the open upper end 18 of the container is a spray head 40 having a cap portion 42 on the bottom side and a handle portion 44 on the rearward end. The cap portion 42 comprises a closed cup shaped member 44 which is open at the bottom and is dimensioned to be received in fitting relation about the upper end 18 of the container with means hereinafter to be described, for removably mounting the cap on the container to seal the open end. The handle portion comprises a curvilinear handle grip 46 which extends angularly downwardly, preferably curvilinearly from the rearward end of the spray head and is rigid with the cap and spray section.

The spray section 40 comprises an elongate horizontally disposed barrel 50 having a bore 52 extending therethrough. A stem 56 extends downwardly for a short distance from an inlet opening 54 which communicates with the bore 52. The barrel terminates at its forward end in a threaded end portion 58 which removably mounts a spray nozzle 60 having a conically shaped passage 62 extending therethrough in endwise alignment with the bore through the barrel. A needle valve 64, having an end portion which terminates a section of conical shape is mounted in the barrel for reciprocal movement through the bore in the direction towards and away from the nozzle between closed and open positions with the tapered end portion 66 of the needle valve seated in the nozzle opening 66 to plug the opening when the needle valve is in closed position and spaced from the nozzle to unplug the opening when in open position.

Means are provided for actuation of the needle valve between open and closed positions and for adjustment to vary the open position whereby the spray volume can be controlled for dispensing the fluid content material by a fine mist or spray and a fluid stream and to adjust the rate at which the material is dispensed. For this purpose, an intermediate wall 68 spans the barrel immediately rearwardly of the inlet 54 for engagement of the barrel walls in sealing relation to seal off the front end of the barrel. The wall is provided with a passage through which an intermediate portion of the needle valve extends in sealing relation to provide support for the needle valve and to provide endwise displacement of the needle valve between open and closed position.

A trigger 70, in the form of an elongate rod, is provided to extend angularly downwardly in spaced relation in advance of the handle 46. The upper end of the trigger 70 is pivoted on a pin 72 fixed to the rearward end portion of the barrel head frame to enable rocking movement of the trigger about the pivot in the direction towards and away from the handle. The rearward end portion of the needle valve is pivotally connected onto a portion 76 of the trigger offset downwardly from its pivot 74 whereby rocking movement of the trigger about the pivot is translated into endwise displacement of the needle valve. Means are provided constantly to urge the trigger rod in a direction away from the handle portion for displacement of the needle valve towards the nozzle with the nozzle opening being plugged by the forward end portion of the needle valve, when displaced to closed position. In the illustrated modification, such means constantly urging the trigger for displacement of the needle valve to closed position comprises a tension spring 78 secured at its forward end 80 to a portion of the barrel head frame while the rearward end is secured at 82 to the trigger offset still further from its pivot whereby greater leverage is provided for urging the trigger and the needle valve towards closed position in response to the constant force applied by the spring.

The character and volume of the dispensing operation can be controlled by varying the spaced relation between the end of the needle valve 64 and the nozzle, when the needle valve is displaced to open dispensing position. Means are provided for stopping the rearward displacement of the needle valve, when in open position, and means are also provided for adjustment controllably to vary the open position and to set the elements for maintaining the desired position of adjustment.

In the illustrated modification, the rearward displacement of the needle valve to open position is determined by a stop 84 fixed to the barrel frame in the path of an abutment 86 mounted on the needle valve for axial movement therewith. Rearward displacement of the needle valve is blocked upon engagement of the abutment 86 with the stop 84, when the needle valve is retracted to open position. For adjustment of the position of the needle valve, when in open position, means are provided for movement of the abutment 86 axially relative to the needle valve to increase or decrease the spaced relation between the abutment 86 and the stop 84. A simple and effective means for achieving such adjustment is illustrated in the drawings in which the abutment 86 is in the form of a disc member having a threaded bore in threaded engagement about a threaded section of the needle valve immediately in advance of the stop 84. Thus the axial position of the abutment relative to the stop can be adjusted merely by rotating the disc member about the needle valve. The top wall of the barrel is cut away to enable access to the periphery of the disc member 86 to enable the disc member to be rotated in one direction or the other. To facilitate turning movement, the disc member is preferably dimensioned to protrude beyond the outer wall of the barrel and the peripheral surface of the disc member is knurled or otherwise provided with gripping means. As illustrated in FIG. 5, the barrel section alongside the disc member can be provided with scales 90 to serve as a gauge for leading the setting of the needle valve for spray position. Of course the character and volume of the dispensing stream can also be regulated by proper selection and interchange of nozzles mounted on the end of the barrel. The dispenser of this invention makes use of a flexible, fluid impervious bag 100 which contains the fluid material to be dispensed and is removably inserted into the container housing. It is preferred that the bag have a capacity and shape which conforms with that of the container, but bags of smaller volume and/or of different shape can be adapted for use in the container. Such bags may be formed of natural or synthetic elastomers, such as butadiene homopolymers or copolymers with styrene and/or acrylonitrile, polyisoprene and the like, but it is preferred to make use of thin walled flexible bags of synthetic polymeric materials such as polyvinyl chloride, polyethylene, polypropylene, ethylene propylene copolymer, polyamide (nylon), polyesters (dacron), polyvinylidene chloride (saran) and the like film forming materials.

Operation of the dispenser of this invention requires that a sealing relation be established between the inserted bag 100 and the container and that the cap 42 make an effective seal with the bag so that the bag will be compressed in response to the introduction of fluid under pressure through the inlet 22 into the area between the bag and the container. Thus the fluid composition to be dispensed will become pressurized in the bag in response to forced compression of the bag. The desired sealing relationship is established by providing the bag with a lengthened open end portion so that the end portion 102 can be wrapped about the upper end of the container, as an overhang, to extend for a distance down the outer wall. Often times, depending somewhat upon the composition of the bag and its fit over the mouth of the container, the overlap is sufficient to establish the desired sealing relationship when the cap is tightened down onto the container. However, in order to militate against rupture of the bag or displacement of the type which might prevent the establishment of a desired sealing relation when the cap is screwed onto the mouth of the container, it is preferred to provide the container with a cap liner 104 in the form of a cylindrical section dimensioned to be received in fitting relation alongside the inner wall of the mouth of the container, with an outwardly extending annular flange 106 which rests upon the portion of the bag draped over the upper edge of the container. Thus, when the cap 42 is tightened down onto the container, the underside of the top wall of the cap engages the liner portion 106 whereby the liner and the overlapping portion of the bag is compressed to establish the desired sealing relationship between the cap and the container, without the bag being exposed to the twisting forces during tightening and removal of the closure.

The interior of the bag communicates with the inlet 54 to the barrel 52 through an intake tube 108 in the form of an elongate hollow tubular member provided with perforations 110 substantially throughout its length to enable the fluid material to flow through said openings into the intake tube and up the tube to the spray head. The upper end portion of the tube is adapted to telescope onto the tubular section 56, having vent openings 112. Thus the intake tube can be easily removed for washing or replacement, as desired.

Figure 2:
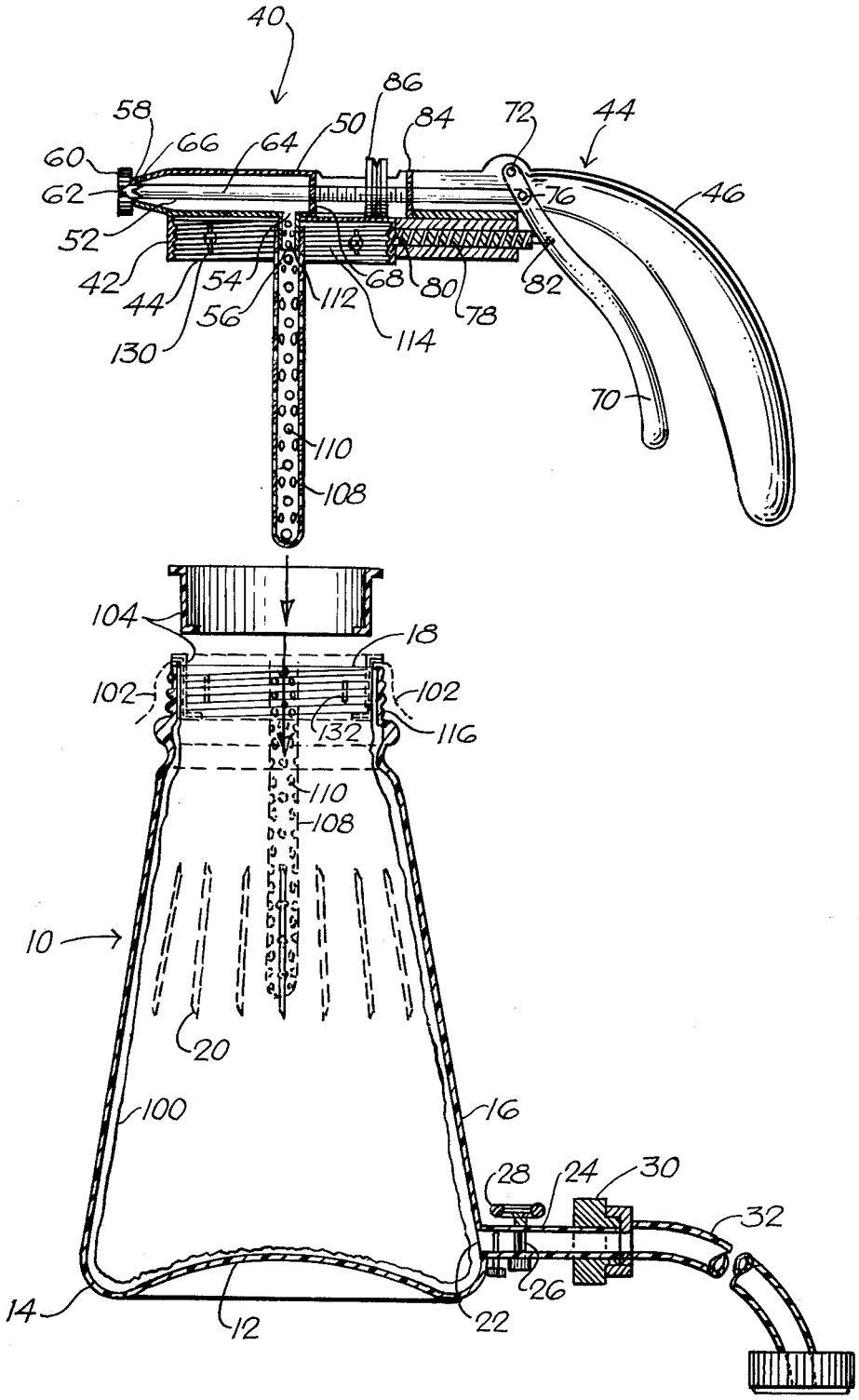
FIG. 2 is an elevational view of the spray bottle of FIG. 1 showing the spray head separated from the bottle and having parts broken away for better illustration of the elements thereof.

Various means, well known to the skilled in the art, can be used removably to secure the spray head in fitting relation onto the mouth of the container. In FIGS. 1 to 3, the inner wall of the cap section is provided with screw threads 114 adapted to interfit with screw threads 116 molded onto the outer wall of the neck portion of the container to enable the cap to be tightened down onto the container in response to relative turning movement. Instead, as illustrated in FIG. 4, the upper end portion of the container can be formed with three or four or more circumferentially spaced apart grooves 118 having a vertical entrant portion 120 which extends to the top edge of the container, and a horizontally disposed downwardly inclined portion 122, while the cap is provided with equally spaced apart detents or wing nuts 124 dimensioned slidably to be received within said grooves for entry into the vertically disposed entry portion 120 and for guidance through the downwardly inclined portion 122 during relative turning movement between the cap and container to force the cap down into sealing engagement with the upper edge of the container and the bag portion and liner, when present, therebetween.

In practice, the bag 100 is inserted through the open mouth into the container and then the upper portion of the bag is draped over and about the upper edge of the container. Thereafter the liner 104 is inserted into the open end to hold the end portion of the inserted bag in place. If the bag 100 has not previously been filled with the material to be dispensed, the fluid can be poured into the bag while it is in the container.

The intake tube 108 is inserted in position of use on the shaft 56 extending downwardly from the base of the spray head and the spray head is then mounted onto the open mouth of the container by screwing the cap onto the container with sufficient tightening to effect a sealed relationship between the cap and the container, with the portion of the bag and liner sandwiched therebetween.

A garden hose 32 is connected to the coupling and the needle valve is set to the calibrated position for dispensing the fluid from the bag retained in sealed relationship within the container.

When it is desired to spray or otherwise dispense the fluid from the bag, the water faucet is turned on and the butterfly valve 26 is turned to open position. This allows water under pressure to enter into the space between the bag and the container to collapse the bag inwardly from the bottom wall and the side walls whereby the fluid content material is caused to flow into and up the intake tube 108 and into the barrel until further flow is blocked by the needle valve 64 plugging the nozzle 60 in closed position. The water pressure, operative to urge further collapse of the bag, operates to pressurize the fluid content material now filling all of the channels to the blocked nozzle.

When finger pressure is applied to retract the trigger arm 70, the needle valve 64 is displaced rearwardly from closed position to open position to unplug the nozzle opening. In response to such release, the water pressure, continuously operative further to collapse the bag, forces the liquid content material through the nozzle at a relatively constant rate. Thus the fluid content material can be dispensed at will by opening and closing the needle valve in response to trigger operation while the fluid material to be dispensed is constantly under pressure.

When the dispensing operation has been completed, the butterfly valve 26 is closed to release the pressure on the bag. Residual pressure can be relieved by spraying a small increment of material or by opening a bleed valve (not shown) in the container. Thereafter, the cap and the spray head can be removed, the liner 104 removed and the bag withdrawn, with any fluid composition remaining therein, for replacement with a refill or with another filled or partially filled or empty bag (subsequently to be filled) with a fluid of a different color, finish, varnish, lacquer, insecticide, herbicide and the like, preferably after the barrel has been cleaned and the uptake tube 108 is replaced or cleaned to enable clean change of material for dispensing.

A feature of this invention is addressed to means for locking the spray head in position of use on the container to prevent inadvertent removal. One such means comprises circumferentially spaced apart wing nuts 130 in the cap portion designed to be in registry with correspondingly spaced vertical grooves 132 in the outer side walls of the container, preferably below the screw portion. Thus, when the cap has been turned into position of use in sealing relation on the container, the wing nuts 130 can be turned to project the through extending portion of the nut into the vertical grooves 132 thereby to lock the cap against rotational movement relative to the container. When it is desired to remove the cap, the wing nuts are first retracted from the grooves to free the cap for relative turning movement.

Another modification is adapted to prevent removal of the spraying head in the event that water has not been turned off to inactivate the pressure conditions existing within the container and on the bag.

In the modification illustrated in FIG. 4, the grooves 118 are provided with continuous grooves 126 extending upwardly a short distance from the top of the groove 118, with the continuous upwardly extending grooves 126 being dimensioned to receive the detent 124. While pressure conditions continue to exist in the container, the cap is urged in the upward direction relative to the container whereby the detent is forced to enter into the upwardly extending continuous grooves 126 to prevent the cap from being turned relative to the container. When, however, the water pressure has been relieved by turning the butterfly valve to closed position or by shutting off the water at the faucet, and the pressure has subsided sufficiently in the container, the cap can be pressed down to enable the detent to clear the blocking groove 126 and permit the cap to be turned relative to the container for removal.

In another ramification wherein use is made of a screw cap, the bottom side of the lowermost screw threads 140 on the container can be formed with rack teeth 142 or surface roughness for meshing with corresponding rack teeth or surface roughness 144 on the top side of the cap groove. Thus in response to upward pressure on the container, the adjacent surfaces bearing surface roughness of rack teeth will interengage to militate against relative turning movement. When the pressure generating means has been inactivated and the pressure has subsided within the container, the cap can be depressed sufficiently to disengage the surfaces to permit the cap to be turned relative to the container for removal.

It will be apparent that the dispenser described is completely portable and can be manipulated by hand to direct a spray in any direction, movement being restricted only by the length of the hose or tubular member connecting the container to the faucet or other supply of pressure fluid.

Instead of hooking the container to a source or supply of water under pressure, the container can be hooked up to a source of air or other gas under pressure whereby the pressurized gas or air acts on the bag in the same manner as the water under pressure.

Instead of allowing the water or other fluid under pressure to act directly onto the bag, to pressurize the content material to be dispensed, use can be made of a container of cylindrical shape, as illustrated in FIG. 3, fitted with a rigid disc 150 having a cross-section corresponding with that of the interior of the container, with one or more vertically spaced sealing rings 152 extending from the periphery of the disc member into sealing engagement with the inner walls of the container whereby the disc member functions as a piston within the container. When use is made of this construction, the inlet 22 for the introduction of water, air or gas under pressure into the container is located between the piston 150 and the bottom wall 12 of the container so that the entry of water and the like fluid under pressure will cause upward displacement of the piston in the container into pressure engagement with the bag to pressurize the fluid content material to be dispensed from the bag.

It will be apparent from the description that the dispenser can be used to dispense all or any portion of the material in the bag and that the bag can be replaced with another filled or partially filled bag thereby to enable dispensing of various materials at different times. Thus the dispenser of this invention is not limited to the dispensing of a single material but can instead be used to dispense varied materials of fluid consistency. Bags filled or partially filled with various materials to be dispensed provide a safe and convenient means for storage. When use is made of transparent or translucent bags, visual observation can be made of the materials contained therein, such as different colored paints, varnishes and the like. The bags also serve as an economical means for saving unused material and for storage until subsequently returned to the container for dispensing.

It will be understood that changes may be made in the details of construction, arrangement and operation without departing from the spirit of the invention, especially as defined in the following claims.

I claim:

1. A portable, hand operated dispenser for spraying fluid composition under pressure comprising a container having an open mouth at the top and an inlet in the body portion below the top, means connecting the inlet with a source of high pressure fluid, a flexible, fluid impervious bag adapted to be filled with the fluid material to be dispensed and to be received within the container with an open upper end portion of the bag draped over and about the wall defining the open upper end of the container, a spray head including a cap portion, a spray portion and a handle portion, said cap portion having means for removably securing the spray head onto the open upper end of the container in sealing relation therewith and with the portion of the bag in between, said spray portion including a tubular section having a nozzle opening at one end and an inlet in communication with the interior of the container when the spray head is in the assembled relation on the container, a needle valve mounted in the tubular section for reciprocal movement in the direction towards and away from the nozzle to plug the nozzle opening when in closed position and to free the opening when in open position, and means for actuating the needle valve between open and closed positions, said handle portion being located immediately rearwardly of the nozzle and cap portions in which the cap portion is formed with an open ended downwardly extending cylindrical skirt and in which the means removably securing the cap portion onto the container comprises screw threads in the skirt and screw threads in the outer wall of the container adjacent the upper end to enable the cap portion to be screwed onto and off of the container, and in which the lowermost screw thread in the cap portion and container are formed with surface roughness or rack teeth in adjacent surfaces to militate against relative turning movement when pressure conditions exist within the container sufficient to urge the cap portion to lift off of the container.

2. A portable hand operated dispenser for spraying fluid composition under pressure comprising a container having an open mouth at the top and an inlet in the body portion below the top, means connecting the inlet with a source of high pressure fluid, a flexible, fluid impervious bag adapted to be filled with the fluid material to be dispensed and to be received within the container with an open upper end portion of the bag draped over and about the wall defining the open upper end of the container, a spray head including a cap portion, a spray portion and a handle portion, said cap portion having means for removably securing the spray head onto the open upper end of the container in sealing relation therewith and with the portion of the bag in between, said spray portion including a tubular section having a nozzle opening at one end and an inlet in communication with the interior of the container when the spray head is in the assembled relation on the container, a needle valve mounted in the tubular section for reciprocal movement in the direction towards and away from the nozzle to plug the nozzle opening when in closed position and to free the opening when in open position, and means for actuating the needle valve between open and closed positions, said handle portion being located immediately rearwardly of the nozzle and cap portions in which the cap portion is formed with an open ended downwardly extending cylindrical skirt and in which the means removably securing the cap portion onto the container comprises projections extending inwardly in circumferentially spaced apart relation from the skirt and corresponding circumferentially spaced apart receiving grooves in the outer wall of the container dimensioned to receive the projections therein, each of said grooves comprising an entrant portion which extends vertically downwardly from the upper edge of the container and a horizontally disposed downwardly inclined cam portion which operates to draw down the cap into sealing relation with the container as the projections are displaced therethrough, which includes means for militating against relative movement between the cap portion and container while pressure conditions exist within the container comprising a continuous groove extending upwardly from the opposite end of each of the horizontally disposed downwardly inclined grooves in the container wall to enable entry of the projections into the vertically disposed grooves when pressure conditions exist to urge the cap in the upward direction off of the container.

* * * * *